US005977554A

United States Patent [19]

Smith et al.

[11] Patent Number: 5,977,554

[45] Date of Patent: Nov. 2, 1999

[54] CONTAINER FOR TRANSPORTING ANTIPROTONS

[75] Inventors: Gerald A. Smith, State College; Raymond A. Lewis, Boalsburg, both of Pa.; Steven D. Howe, Los Alamos, N.Mex.

[73] Assignee: The Penn State Research Foundation, University Park, Pa.

[21] Appl. No.: 09/046,064

[22] Filed: Mar. 23, 1998

[51] Int. Cl.[6] ..... H05H 13/00

[52] U.S. Cl. ..... 250/493.1; 376/127; 376/156; 313/62

[58] Field of Search ..... 250/493.1, 503.1, 250/281, 282, 292, 423 R, 424, 306, 307; 376/127, 129, 130, 156; 313/62

[56] References Cited

U.S. PATENT DOCUMENTS

| | | | |
|---|---|---|---|
| 3,986,026 | 10/1976 | Martin | 250/306 |
| 4,139,777 | 2/1979 | Rautenbach . | |
| 4,507,616 | 3/1985 | Blosser et al. . | |
| 4,639,634 | 1/1987 | Meyrand . | |
| 4,641,104 | 2/1987 | Blosser et al. . | |
| 4,771,208 | 9/1988 | Jongen et al. . | |
| 4,867,939 | 9/1989 | Deutch . | |
| 4,943,781 | 7/1990 | Wilson et al. . | |
| 5,139,731 | 8/1992 | Hendry . | |
| 5,206,506 | 4/1993 | Kirchner . | |
| 5,241,244 | 8/1993 | Cirri . | |
| 5,463,291 | 10/1995 | Carroll et al. . | |
| 5,468,355 | 11/1995 | Shefer et al. . | |
| 5,521,469 | 5/1996 | Laisné . | |

OTHER PUBLICATIONS

M.H. Holzssscheiter, X. Feng, T. Goldman, N.S.P. King, R.A. Lewis, M.M. Nieto and G.A. Smith, Are antiprotons forever?, Physics Letters A 214 (1996) 279–284, Elsevier Science B.V., The Netherlands.

D.J. Wineland and H.G. Dehmelt, Principles of the stored ion calorimeter*, Journal of Applied Physics, vol. 46, No. 2, Feb. 1975, pp. 919–930.

R.A. Lewis, G.A. Smith and S.D. Howe, Antiproton portable traps and medical applications*, Hyperfine Interactions 109 (1997) 155–164, J.C. Baltzer AG, Science Publishers.

Malcolm W. Browne, Physicists Succeed in Creating Atoms Out of Antimatter, The New York Times International, Friday, Jan. 5, 1996.

Harold McFarlane et al., Transactions of the American Nuclear Society, vol. 74, pp. 136–137, Jun. 16–20, 1996, American Nuclear Society, Incorporated, La Grange Park, Illinois 60526.

Jerome M. Rosen, Capturing Antimatter, Compressed Air, Jun. 1997, pp. 50–57.

Malcolm W. Browne, Physicist Strive To Create Atoms of Antihydrogen From Antimatter, The New York Times, Science Times, Tuesday, Nov. 15, 1994.

Andrew Watson, Trapped antimatter holds on to life, New Scientist, Jan. 13, 1996, p. 18.

Stanley K. Borowski and Brice N. Cassenti, Nuclear thermal propulsion, Aerospace America, Dec. 1995, p. 49.

(List continued on next page.)

*Primary Examiner*—Kiet T. Nguyen
*Attorney, Agent, or Firm*—Thomas J. Monahan

[57] ABSTRACT

The invention provides a container for transporting antiprotons including a dewar having an evacuated cavity and a cryogenically cold wall. A plurality of thermally conductive supports are disposed in thermal connection with the cold wall and extend into the cavity. An antiproton trap is mounted on the extending supports within the cavity. A sealable cavity access port selectively provides access to the cavity for selective introduction into and removal from the cavity of the antiprotons. The container is capable of confining and storing antiprotons while they are transported via conventional terrestrial or airborne methods to a location distant from their creation.

37 Claims, 10 Drawing Sheets

OTHER PUBLICATIONS

David Graham, Have Antimatter, Will Travel, Technology Review, Trends, Jul. 14, 1994, pp. 14–15.
Portable Source Produces PET Radioisotopes "On Demand",Radiology & Imaging Letter, Nov. 15, 1995, vol. 15, No. 20.
Justin Warner, A churnful of antiprotons, please, New Scientist, Sep. 17, 1994, p. 20.
Valerie Manns, Anti–matter research really matters, Centre Daily Times, Jul. 7, 1997.
Frank D. Roylance, The real world of antimatter, Baltimore Sun, Sunday, Jun. 22, 1997, p. 2A.
Fred Guterl, A Small Problem of Propulsion, Discover, Oct. 1995, pp. 102–108.

CONTAINER FOR TRANSPORTING ANTIPROTONS

FIELD OF INVENTION

The present invention generally relates to the confinement, storage, and transportation of highly transitory and reactive materials, and more particularly to the confinement, storage and transportation of antimatter.

BACKGROUND OF THE INVENTION

Antimatter consists of subatomic particles that are structurally identical to subatomic particles of matter, but have opposite fundamental properties. For example, positrons (antielectrons) possess the same quantum characteristics as electrons (spin, angular momentum, mass, etc.) but are positively charged. Antiprotons possess the same quantum characteristics as protons, but are negatively charged. When an antiparticle, such as an antiproton, collides with its corresponding matter particle (in this case a proton) they annihilate each other, converting their mass into energy. Antimatter annihilates so readily that it only exists on earth when it is artificially generated in high-energy particle accelerators. Elaborate means have been developed for storing antimatter on earth once it has been created. Often these means have included large, fixed machines such as the low-energy antiproton ring (LEAR) at CERN, in Switzerland, or the Antiproton Accumulator at Fermilab in the United States. Devices such as LEAR are extraordinarily complex, and relatively expensive to build, maintain, and operate.

Apparatus and methods for the production, containment and manipulation of antimatter, on a commercial scale, are also known in the art. For example, U.S. Pat. No. 4,867,939, issued to Deutch on Sep. 1989, provides a process for producing antihydrogen which includes providing low-energy antiprotons and positronium (a bound electron-positron atomic system) within an interaction volume. Thermalized positrons are directed by electrostatic lenses to a positronium converter, positioned adjacent to a low-energy (less than 50 KeV) circulating antiproton beam confined within an ion trap. Collisions between antiprotons and ortho-positronium atoms generate antihydrogen, a stable antimatter species.

Deutch proposes use of an ion trap which can be either a high-vacuum penning trap or a radio frequency quadrupole (RFQ) trap, with a racetrack design RFQ trap being preferred. Deutch provides non-magnetic confinement of the antimatter species by use of dynamic radio frequency electric fields. Deutch does not disclose any method or apparatus for confining antiprotons in a manner appropriate for their storage and transportation to a location distant from their creation.

In U.S. Pat. No. 5,206,506, issued to Kirchner on Apr. 27, 1993, an ion processing unit is disclosed including a series of M perforated electrode sheets, driving electronics, and a central processing unit that allows formation, shaping and translation of multiple effective potential wells. Ions, trapped within a given effective potential well, can be isolated, transferred, cooled or heated, separated, and combined. Kirchner discloses the combination of many electrode sheets, each having N multiple perforations, to create any number of parallel ion processing channels. The ion processing unit provides an N by M, massively-parallel, ion processing system. Thus, Kirchner provides a variant of the well known non-magnetic radio frequency quadrupole ion trap that is often used for the identification and measurement of ion species. Kirchner's multiple electrode structures (FIGS. 1 and 2) appear to serve as an ion source and confinement barrier.

Kirchner suggests that his apparatus is well suited for storing antimatter. More particularly, Kirchner suggests that as antimatter is produced, groups of positronium or other charged antimatter can be introduced into each processing channel and held confined to an individually effective potential well. Kirchner also suggests that large amounts of antimatter could thereby be "clocked-in" just as an electronic buffer "clocks-in" a digital signal. It would appear that the adaptive fields created by Kirchner's device might allow for the long-term storage of antimatter in a kind of electrode sponge. However, in suggesting the application of his device to antimatter confinement, Kirchner fails to disclose many essential aspects of such a device. For one thing, he makes no mention of vacuum requirements, which are essential to long-term confinement, storage, and transportation of antimatter. For another thing, Kirchner fails to provide any effective means for introducing antimatter, e.g., antiprotons, into his device or for effectively removing them from his device once they have been "clocked" through.

Antimatter could have numerous beneficial commercial applications if it could be effectively stored and transported. For example, antiprotons may be usefully employed to detect impurities in manufactured materials, e.g., fan blades for turbines. Positrons (generated by radioisotopes of common elements) are used for medical imaging applications, e.g., Positron Emission Tomography (PET), which does not require the delivery of radiation as in conventional x-rays and cat scans. Additionally, concentrated beams of antiprotons may be directed onto diseased tissue, e.g., cancer cells, to deliver concentrated radiation to those cells thereby destroying them, but without significantly affecting surrounding healthy tissue.

Commercial and industrial applications of antiprotons have been hampered by the fact that such activities must be undertaken at, or very close to, the place where antiprotons are generated, e.g., a high energy physics laboratory operating a synchrotron or the like. This is due to the very short life expectancy of an antiproton. As a result, antiprotons are not often used in, e.g., medical applications in public and private hospitals, due to the extraordinary requirements associated with the operation of a synchrotron of the type used to generate antiprotons in significant quantities.

In particular, a need exists in the biomedical radioisotope arts for a transportable source of positron emitting isotopes with short half-lives for use in PET imaging procedures. For example, radioactive fluorine (positron emitter) is often produced in small synchrotrons that are located at central hospital complexes. In this procedure, a collection of non-radioactive fluorine atoms are bombarded with a stream of antiprotons emanating from the synchrotron ring. A number of antiprotons from the stream will interact with a corresponding number of fluorine atoms. During this interaction, an antiproton will knock one of the neutrons situated in the nucleus out of the fluorine atom. The reduction in the number of protons in the nucleus of the fluorine atom causes it to become radioactive, and eventually to emit a positron as a decay product. These radioactive isotopes of fluorine are then introduced into a patient's body where their decay is monitored.

The clinical operation, however, is difficult and expensive because of the 120 minute half-life of the isotope. The procedure could be made considerably less expensive, and more convenient, if the necessary short-lived isotopes could be produced in sufficient quantities at the patient's bedside using a portable source of antiprotons. The prior art does not disclose a container adapted for confining, storing, and transporting antiprotons that is capable of movement, via conventional terrestrial or airborne methods, to a location distant from their creation. Such a container would not only need to be capable of maintaining an effective population of antiprotons, at sufficient population levels, to provide adequate quantities for use in medical and industrial applications, it would also need to be small enough in size to be easily handled in a hospital environment, preferably including a patient's room. Also, such a container would need to be both capable of manufacture at a reasonable cost and reusable.

SUMMARY OF THE INVENTION

In its broadest aspects, the invention provides a container for transporting antiprotons including a dewar having an evacuated cavity and a cryogenic cold wall. A plurality of thermally conductive supports are disposed in thermal connection with the cold wall and extend into the cavity. An antiproton trap is mounted on the extending supports within the cavity. A sealable cavity access port selectively provides access to the cavity for selective introduction into and removal from the cavity of the antiprotons. The container is capable of confining and storing antiprotons while they are transported, via conventional terrestrial or airborne methods, to a location distant from their creation.

In one embodiment, a container for transporting antiprotons is provided that comprises a dewar having an evacuated cavity, a cryogenic cold wall, and a plurality of thermally conductive supports in thermal connection with the cold wall and extending into the cavity. An antiproton trap, having a longitudinal axis, is mounted on the extending supports within the cavity. The antiproton trap comprises at least one magnet having a longitudinally extending open ended passageway that is capable of (i) providing an antiproton confinement region within the open ended passageway and (ii) having a substantially longitudinally oriented magnetic field. At least two hollow electrodes are coaxially positioned within the open ended passageway of the at least one magnet thereby forming an inner passageway. The at least two hollow electrodes are electrically insulated from the at least one magnet and positioned so that one electrode is disposed on a first side of the antiproton confinement region and one of the at least two electrodes is disposed on a second side of the antiproton confinement region. A sealable access port is disposed in aligned relation with the inner passageway and selectively provides access to the cavity and the environment surrounding the dewar. The sealable access port may also include means for separating the evacuated cavity portion of the container from a warmer evacuated portion of means for injecting/ejecting antiprotons into the antiproton trap. Electrical conductors are connected to the at least two hollow electrodes and are selectively connectable to a source of electrical potential (shown generally at reference numeral 510 in FIG. 1). In this way, the at least two hollow electrodes are selectively energizable so as to selectively provide electric fields to control the position of the antiprotons relative to the antiproton confinement region.

In its broadest aspects, the present invention also comprises a method for transporting antiprotons to a point of use comprising the steps of providing an antiproton confinement region comprising ultra-low pressure, ultra-low temperature, and having a predetermined magnetic field and providing a first electric field having a portion extending into the antiproton confinement region. Antiprotons are introduced into the antiproton confinement region where the antiprotons are influenced by the first electric field. A second electric field is provided having a portion extending into the antiproton confinement region from a different direction than the first electric field and which is substantially equal in strength to the first electric field so that the antiprotons are trapped in a potential well formed between the first and second electric fields. The antiprotons are then transported while maintaining the opposing electric fields. The second electric field is then reduced in strength when the antiprotons have arrived at the point of use whereby the first electric field urges the antiprotons to move from the antiproton confinement region.

Another inventive aspect of the present invention is the provision of a system for generating biomedically useful radioisotopes at the bedside of a patient. The system of this embodiment comprises a synchrotron adapted for creating antiprotons and positioned at a point that is relatively distant from the bedside of the patient. A first container that is suitable for transporting antiprotons from the synchrotron to the patient's bedside is provided comprising a dewar having an evacuated cavity and a cryogenically cold wall, a plurality of thermally conductive supports in thermal connection with the cold wall and extending into the cavity, and an antiproton trap mounted on the extending supports within the cavity. A sealable cavity access port in the container selectively provides access to the cavity for selective introduction into and removal from the cavity of the antiprotons. A second container is provided for housing a predetermined quantity of pharmacologically active chemicals, one known property of which is their suitability for transformation into a biomedical radioisotope by bombardment with antiprotons. The second container is adapted for interconnection and release from the first container. Means are provided for injecting/ejecting antiprotons into/out-of the antiproton trap, such as a suitably adapted einsel lens assembly.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
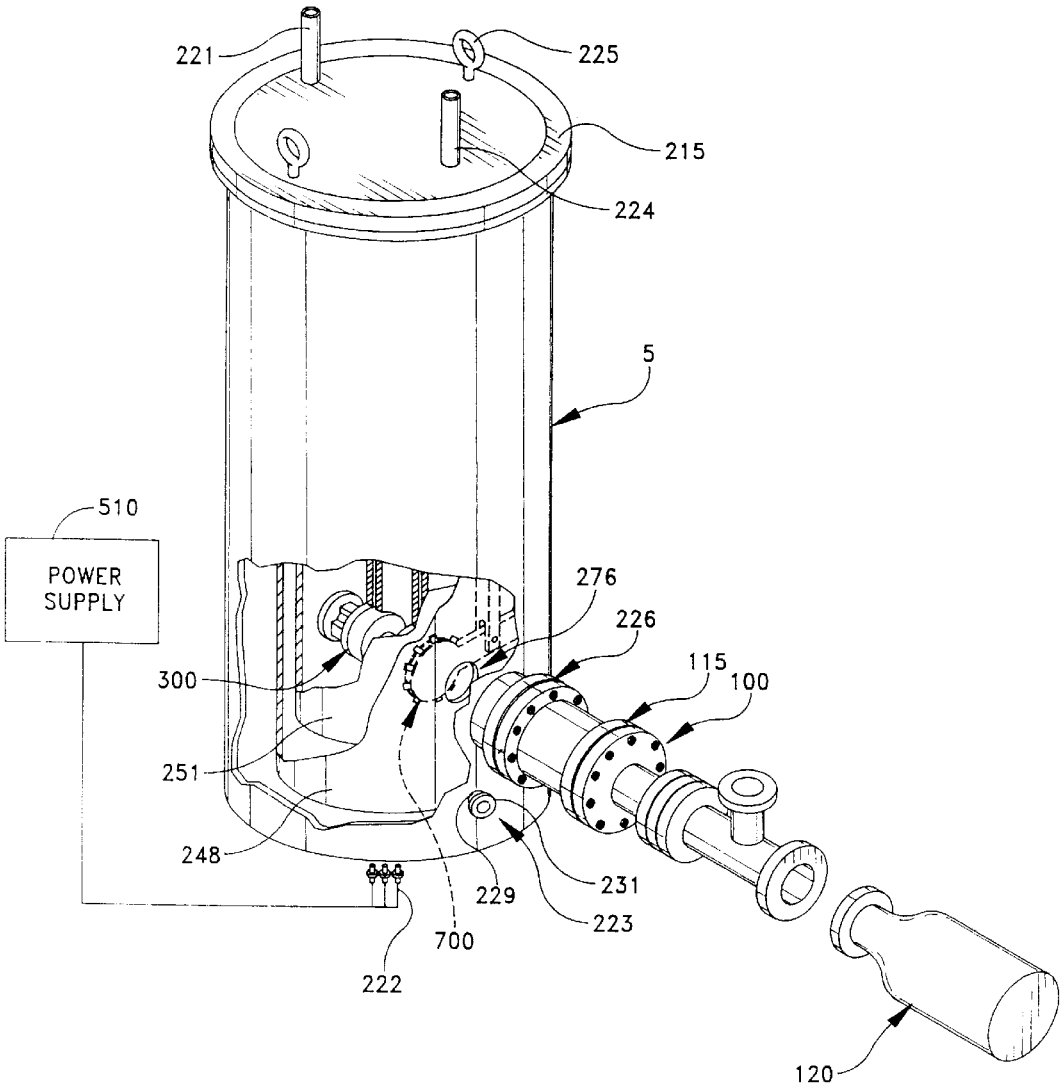
FIG. 1 is a perspective view, partially broken away, of a container for transporting antiprotons formed in accordance with the present invention and having an antiproton injection/ejection snout assembly attached to a lower portion of the container.
Figure 2:
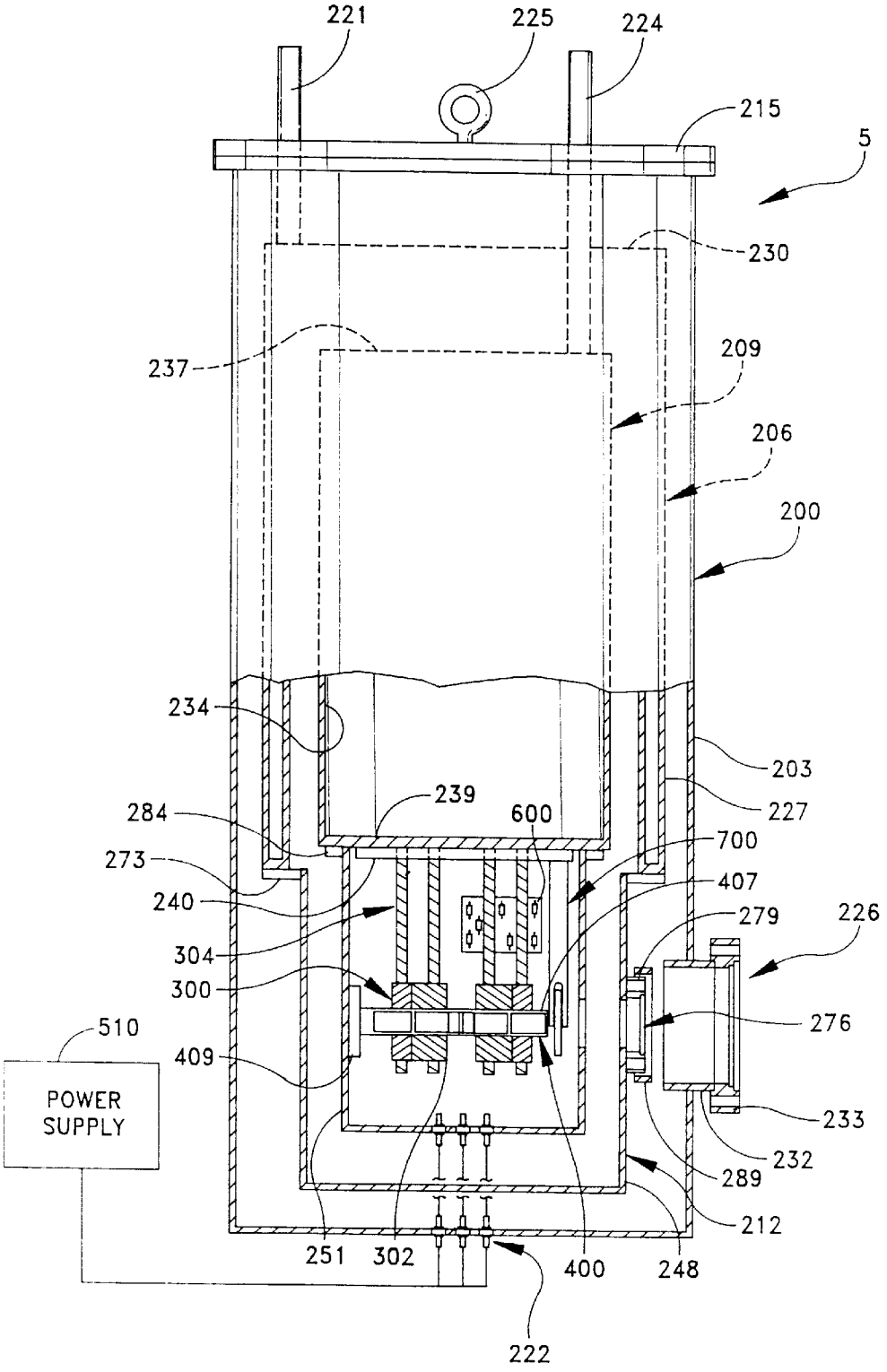
FIG. 2 is a front elevational view, in cross-section, of the container shown in FIG. 1, as taken along lines 2—2, and with the snout assembly removed.
Figure 3:
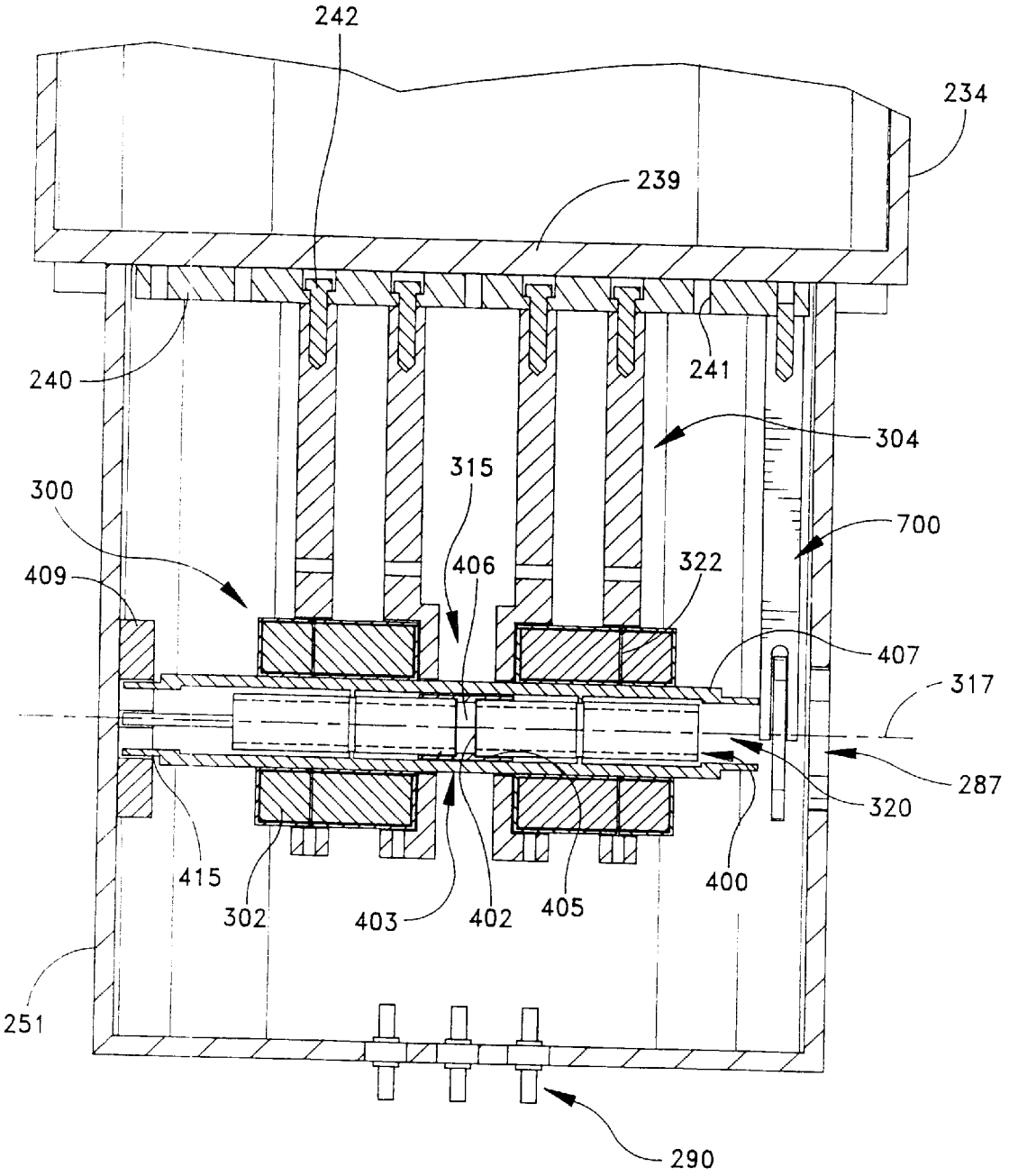
FIG. 3 is a cross-sectional view of an inner portion of the tail assembly that has been broken-away from the container for clarity of illustration.

FIG. 1 shows a container 5 for confining, storing and transporting antiprotons, and a snout assembly 100 for injecting/ejecting antiprotons into and out of container 5. Referring to FIGS. 1, 2 and 3, antiproton container 5 comprises a dewar assembly 200, a magnet assembly 300, an electrode assembly 400, a detector 600 and a shutter assembly 700.

Dewar assembly 200 includes an outer vacuum shell 203, at least two coolant reservoirs 206 and 209, and a tail assembly 212 that are arranged to withstand and maintain ultra-low, "cryogenic" temperatures, i.e., temperatures of no more than 100 degrees above absolute zero, as measured in degrees Kelvin. Outer vacuum shell 203 comprises a blind cylindrical shape having a top plate 215 that is adapted to releaseably hermetically seal the open top end of vacuum shell 203. Vacuum shell 203 is typically formed from stainless steel or the like. A first tubular fill line 221 and a second tubular fill line 224 extend through top plate 215. A pair of lifting eyelets 225 project outwardly from top plate 215 and are adapted for engagement with lifting hooks or lines so that container 5 may be moved from place to place, e.g. from a synchrotron site to the bed of a truck or airplane.

Vacuum shell 203 also comprises high voltage ports 222, a vacuum feed port 223, and a snout interface port 226 (FIG. 1). High voltage ports 222 are adapted to provide electrical access to the interior of container 5, and may comprise any of the well known electrical interconnection devices that are suitable for use with ultra-low vacuum systems. Vacuum feed port 223 is defined by an outwardly projecting, tubular cylinder 229 having a radially-outwardly projecting annular coupling flange 231. Snout interface port 226 is defined by an outwardly projecting, tubular cylinder 232 having a radially-outwardly projecting annular coupling flange 233.

Figure 4:
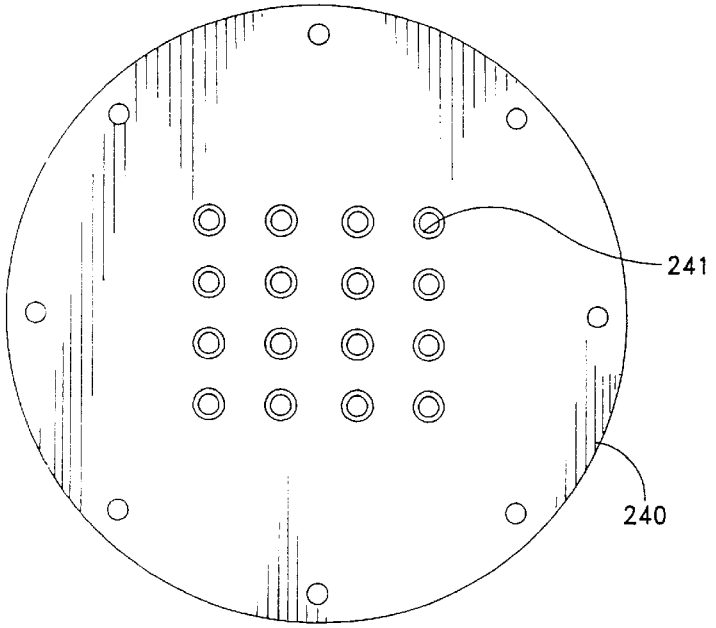
FIG. 4 is a front elevational view of a base plate used in connection with a second reservoir in the container shown in FIG. 1.

Referring to FIG. 2, first reservoir 206, comprises a blind, hollow cylindrical shape defined by a hollow cylindrical wall 227 that is adapted to contain a first coolant, e.g., liquid nitrogen. First reservoir 206 includes a closed top end 230 and an open bottom end, and has an outer diameter sized so that it may be received within the interior of vacuum shell 203 and an inner diameter sized so that second reservoir 209 may be disposed within. First fill line 221 is disposed in fluid communication with the interior of hollow cylindrical wall 227 to provide an opening for introducing the first coolant therein. Second reservoir 209 comprises cylindrical wall 234, a top 237 and a bottom 239 that together define a hollow interior cavity within second reservoir 209. Second fill line 224 is disposed in fluid communication with the interior cavity of second reservoir 209 to provide an opening for introducing a second coolant, e.g., liquid helium, into second reservoir 209. Second reservoir 209 is sized so as to be coaxially disposed within first reservoir 206. A base plate 240 that is fastenable to bottom 239 (e.g., by bolts, welds, or other means) acts as a cold wall interface with magnet assembly 300 and electrode assembly 400, as will hereinafter be disclosed in further detail. A plurality of bores 241 extend through base plate 240 (FIGS. 3, 4 and 9) and are adapted to receive fasteners, e.g., threaded bolts 242 or the like.

Referring to FIGS. 1, 2 and 3, tail assembly 212 completes dewar assembly 200, and includes a first tail 248, and a second tail 251. First tail 248 comprises a blind, hollow cylinder having a similar diameter to first reservoir 206. An annular flange 273 projects radially-outwardly from the edge of the open end of first tail 248. A beam port 276 is disposed in the cylindrical wall of first tail 248. Beam port 276 is defined by an outwardly projecting, tubular cylinder 279 having a radially-outwardly projecting annular coupling flange 281 disposed at its free end. Typically, the aperture of beam port 276 is approximately 3.2 cm in diameter.

Second tail 251 comprises a blind, hollow cylinder having a similar diameter to second reservoir 209. An annular flange 284 projects radially-outwardly from the edge of the open end of second tail 251. A beam port 287 (FIG. 3) is defined by a through-bore disposed in the cylindrical wall of second tail 251. A plurality of vacuum feed-through ports 290 extend through the closed end of second tail 251.

Figure 5:
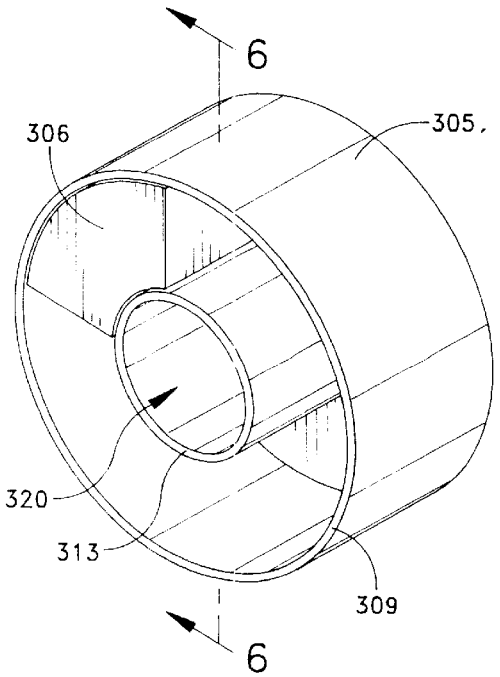
FIG. 5 is a perspective view of an individual magnet jacket containing one segment-shaped magnetic insert.
Figure 6:
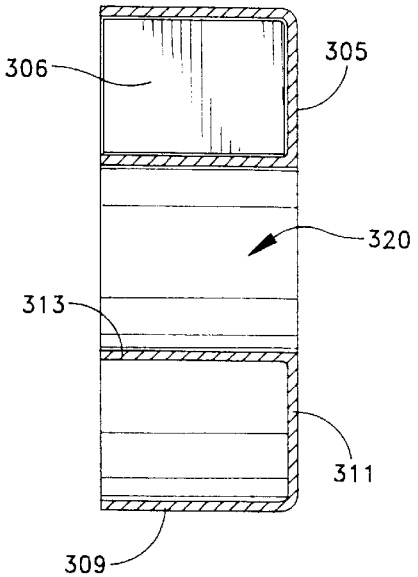
FIG. 6 is a cross sectional view of the magnet jacket shown in FIG. 5.
Figure 7:
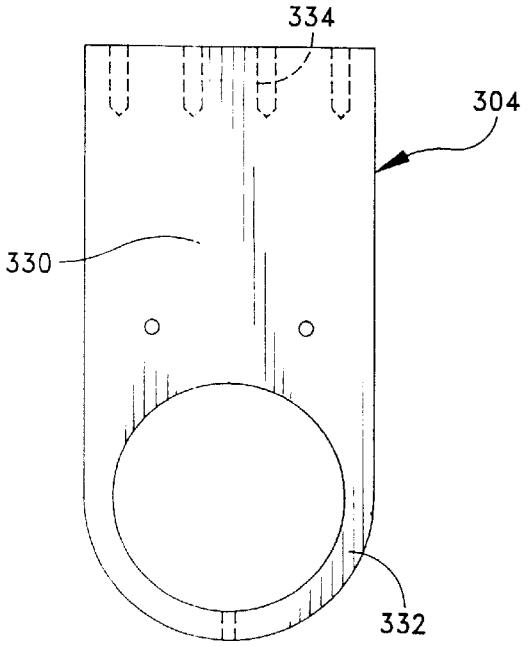
FIG. 7 is a front elevational view of a magnet support.
Figure 8:
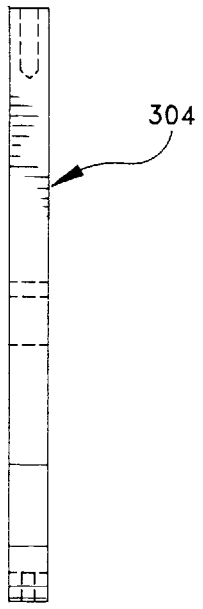
FIG. 8 is a side elevational view of the magnet support of FIG. 7.

Referring to FIGS. 2–16, magnet assembly 300 and electrode assembly 400 together form the functional elements of an antiproton trap. Magnet assembly 300 (FIGS. 2 and 3) typically comprises four magnets 302 and four magnet supports 304. More particularly, each magnet 302 comprises a substantially torroidally shaped jacket 305 (FIGS. 5 and 6) housing a plurality of segment-shaped magnetic inserts 306. Torroidally shaped jacket 305 is formed so as to define an open ended recess 307 between an outer wall 309, a bottom wall 311, and a centrally disposed cylindrical tube 313 that projects upwardly from the inner surface of bottom wall 311. (FIGS. 5 and 6). Each torroidally shaped jacket 305 is sized and shaped so that, when assembled to other jackets, they may be arranged into pairs of magnets comprising an inner and an outer magnet in each pair, with a gap 315 disposed between the inner magnets of the two pairs (FIG. 3). In this arrangement, each cylindrical tube 313 of each magnet 302 is coaxially aligned along a common longitudinal axis 317 to form an open ended passageway 320 through magnet assembly 300, a portion of which is shown as a part of FIGS. 5 and 6.

Plurality of segment-shaped magnetic inserts 306 are preferably formed from sintered powdered metal alloys, such as SmCo, NdFeB or the like, and typically have the properties disclosed in the following table:

| | Density g/cm$^3$ | Curie-temp. ° C. | Spec. electr. resistance Ωmm$^2$/m | Spec. heat J/(kg · K) | Thermal Conductivity W/(m · K) | Coefficient of expansion 20–100° C. ‖c $10^{-4}$/K | Coefficient of expansion 20–100° C. ⊥c $10^{-8}$/K | Young's modulus kN/mm$^2$ | Banding strength N/mm$^2$ | Compressive strength N/mm$^2$ | Vickers hardness HV | Stress crack resistance $K_c$ N/mm$^{3/2}$ |
|---|---|---|---|---|---|---|---|---|---|---|---|---|
| NdFeB | 7.5 | ca.310 | 1.4–1.6 | ca.440 | ca.9 | 5 | −1 | 150 | ca.270 | ca.1050 | ca.570 | 70–90 |
| $Sm_2Co_{17}$ | 8.4 | ca.800 | 0.75–0.85 | ca.390 | ca.12 | 10 | 12 | 150 | 90–150 | ca.850 | ca.640 | 40–50 |
| $SmCo_5$ | 8.4 | ca.720 | 0.5–0.6 | ca.370 | ca.10 | 7 | 13 | 110 | ca.120 | ca.1000 | ca.550 | 50–70 |

Electromagnets may be substituted for permanent magnets 302 in the present invention, although they are not a preferred means for providing the necessary magnetic fields.

Preferably, the two inner magnets 302 are transversely (i.e., radially) polarized and are positioned adjacent to gap 315. Of these two inner magnets, one is polarized so as to have a net radial field component directed radially-inwardly and one is polarized so as to have a net radial field component directed radially-outwardly, relative to longitudinal axis 317 of open ended passageway 320. The outer two magnets are longitudinally polarized to both have a net longitudinal field component directed inwardly, toward gap 315. Axial magnetic fields on the order of about 3500 to 4500 Gauss are typically found in the region defined by gap 315. Washer seals and spacers 322 are positioned between each magnet 302 during assembly, and are typically formed from stainless steel or the like.

Figure 9:
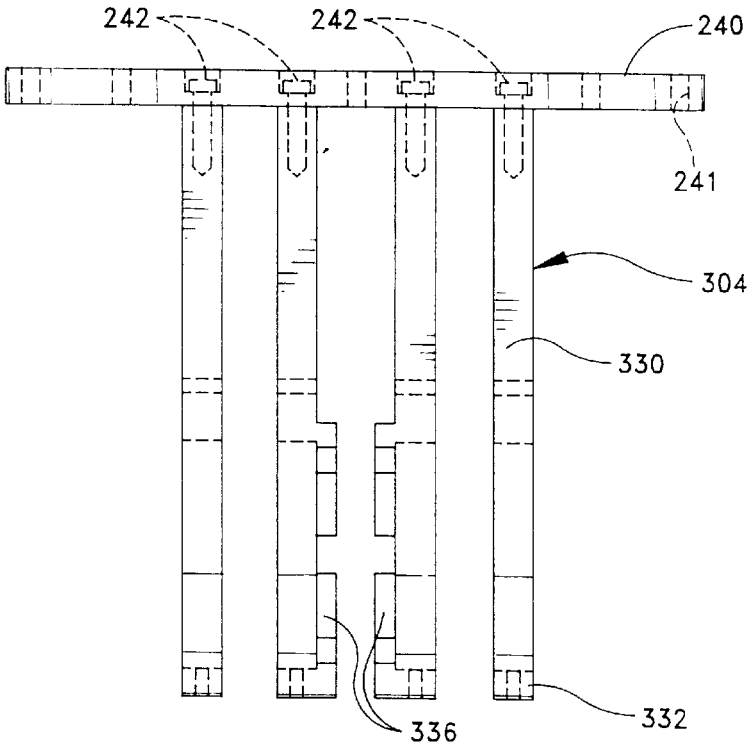
FIG. 9 is a side elevational view of a plurality of magnet supports mounted to the base plate of FIG. 4 and showing inner magnet supports having a plurality of circumferentially arranged projections provided about the yoke.
Figure 10:
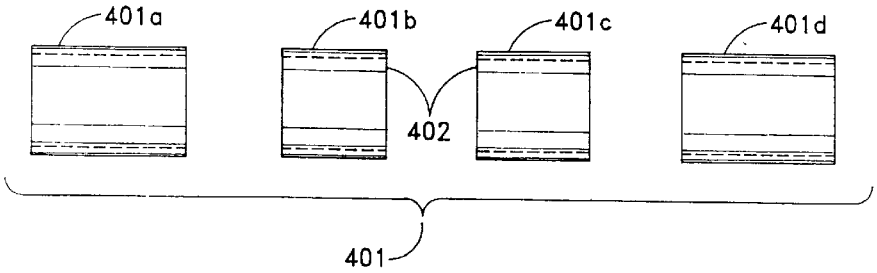
FIG. 10 is a side elevational view of an electrode assembly.

Referring to FIGS. 3 and 7–9, magnet supports 304 each include a cold finger 330 and a yoke 332. Cold fingers 330 comprise a planar plate of highly thermally conductive material, e.g., copper or an alloy thereof. A plurality of blind bores 334 are arranged at one end of each cold finger 330. One yoke 332 is disposed at an end of each magnet support 304. The internal diameter of each yoke 332 is sized and shaped to receive at least one of torroidal magnets 302. At least two inner yokes also include a plurality of circumferentially arranged projections 336 that provide support for the inner magnets 302 (FIG. 9). During assembly of container 5, four cold fingers 330 are fastened to the underside of base plate 240 of second reservoir 209 in generally parallel relation to one another and substantially perpendicular relation to base plate 240 (FIGS. 1–3). As a result of this arrangement, cold fingers 330 and base plate 240 are disposed in intimate thermal communication with one another.

Referring to FIGS. 3 and 10–13, electrode subassembly 400 includes electrodes 401 and spacer assembly 403. In one embodiment, four electrodes, 401*a*, 401*b*, 401*c*, and 401*d* (401*a–d*) are utilized. Electrodes 401*a–d* comprise a plurality of discrete, coaxially aligned cylindrical tubes sized so as to fit loosely within open ended passageway 320 of magnets 302. Electrodes 401 are typically formed from a highly conductive metal, such as copper or its alloys. Gap 315 is further defined by the spaced-apart edges 402 of inner electrodes 401*b*, 401*c* (FIG. 3). The portion of gap 315 disposed between inner electrodes 401*b* and 401*c* defines an antiproton confinement region in which an effective electrical potential well may be formed which is suitable for penning antiprotons, as will hereinafter be disclosed in further detail. Electrodes 401 are individually interconnected to a source of high voltage electrical potential (shown generally at reference numeral 510 in FIG. 1) via conventional electrical conductors (not shown), so that each electrode may be independently energized as required during injection, storage, transport, and ejection of the antiprotons, as will hereinafter be disclosed in further detail.

Figure 11:
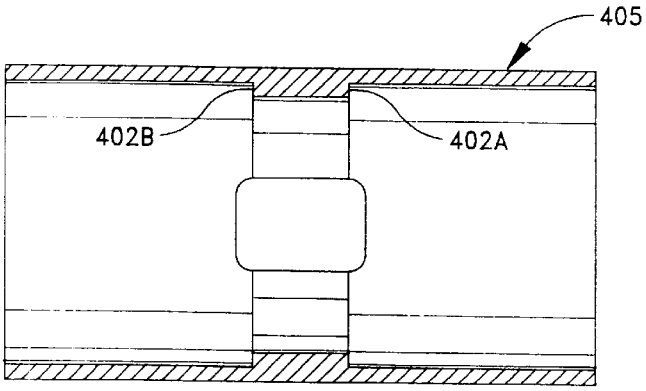
FIG. 11 is a cross-sectional view of a magnet mount.
Figure 12:
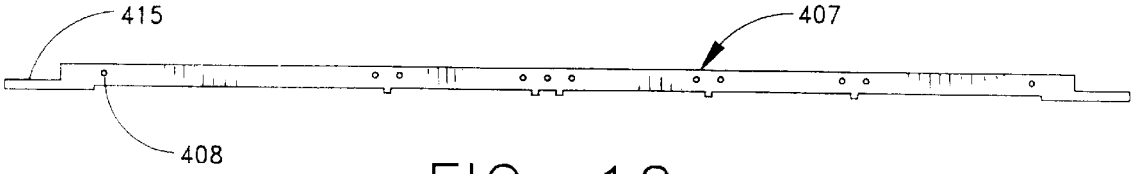
FIG. 12 is a side elevational view of a dielectric spacer bar.
Figure 13:
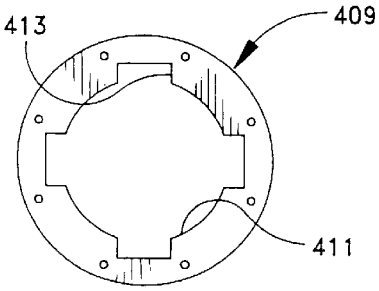
FIG. 13 is a front elevational view of an end ring.

Referring to FIGS. 3 and 11–13, spacer assembly 403 includes magnet mount 405, spacer bars 407, and end rings 409. More particularly, magnet mount 405 comprises a cylindrical tube sized to fit within open ended passageway 320 of magnet assembly 300, and disposed across gap 315. Magnet mount 405 has a diameter that is sized to receive portions of innermost electrodes 401*b* and 401*c*, as shown in FIGS. 3 and 11. A pair of shoulders 402A and 402B are formed in the surface of the internal wall of magnet mount 405, and are adapted to engage edges 402 of electrodes 401*b* and 401*c* so as to create a gap 406 therebetween. Magnet mount 405 is preferably formed from a non-magnetic material, e.g., a polymer such as Macor® brand, or aluminum or the like. Spacer bars 407 comprise elongate spars having a length in excess of the length of open ended passageway 320. Spacer bars 407 are preferably formed from non-magnetic and electrically non-conductive materials. A plurality of through bores 408 are defined along the length of each spacer bar 407, and are adapted to receive fasteners, e.g., screws, bolts, etc. Spacer bars 407 are fastened to the outer surfaces of magnet mount 405 to form a cradle that is adapted for receiving electrodes 401*a–d* and to prevent electrical contact between magnets 302 and electrodes 401. End ring 409 (FIGS. 2, 3, and 13) comprises a cruciform-shaped central opening 411 having notches 413 that are adapted to receive ends 415 of spacer bars 407 to complete the electrode cradle.

Figure 14:
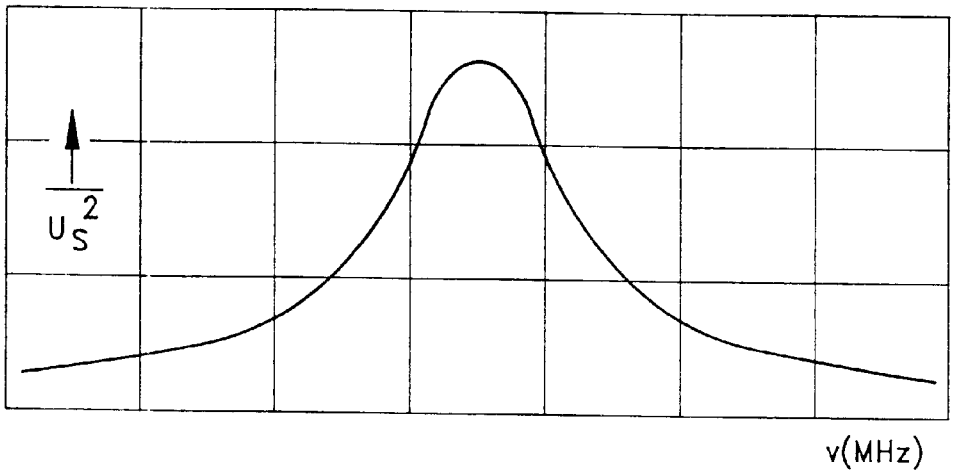
FIG. 14 is a graphical representation of a typical plot of the signal voltage versus noise frequency spectrum for the antiproton confinement region of the present invention without antiprotons resident therein.
Figure 15:
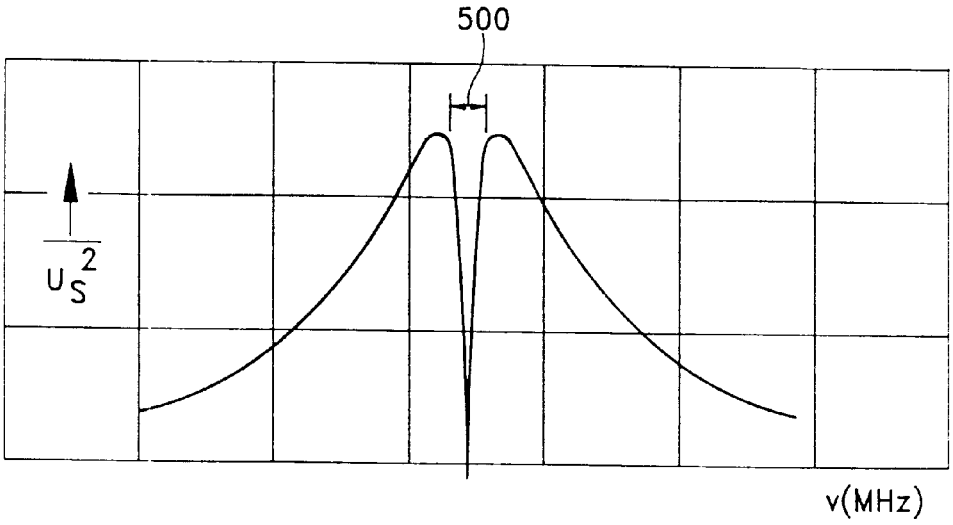
FIG. 15 is a graphical representation of a plot of signal voltage versus noise frequency spectrum, similar to that shown in FIG. 14, but with the noise from the center of the spectrum shunted by the effective impedance of antiprotons resident within the antiproton confinement region of the invention.
Figure 16:
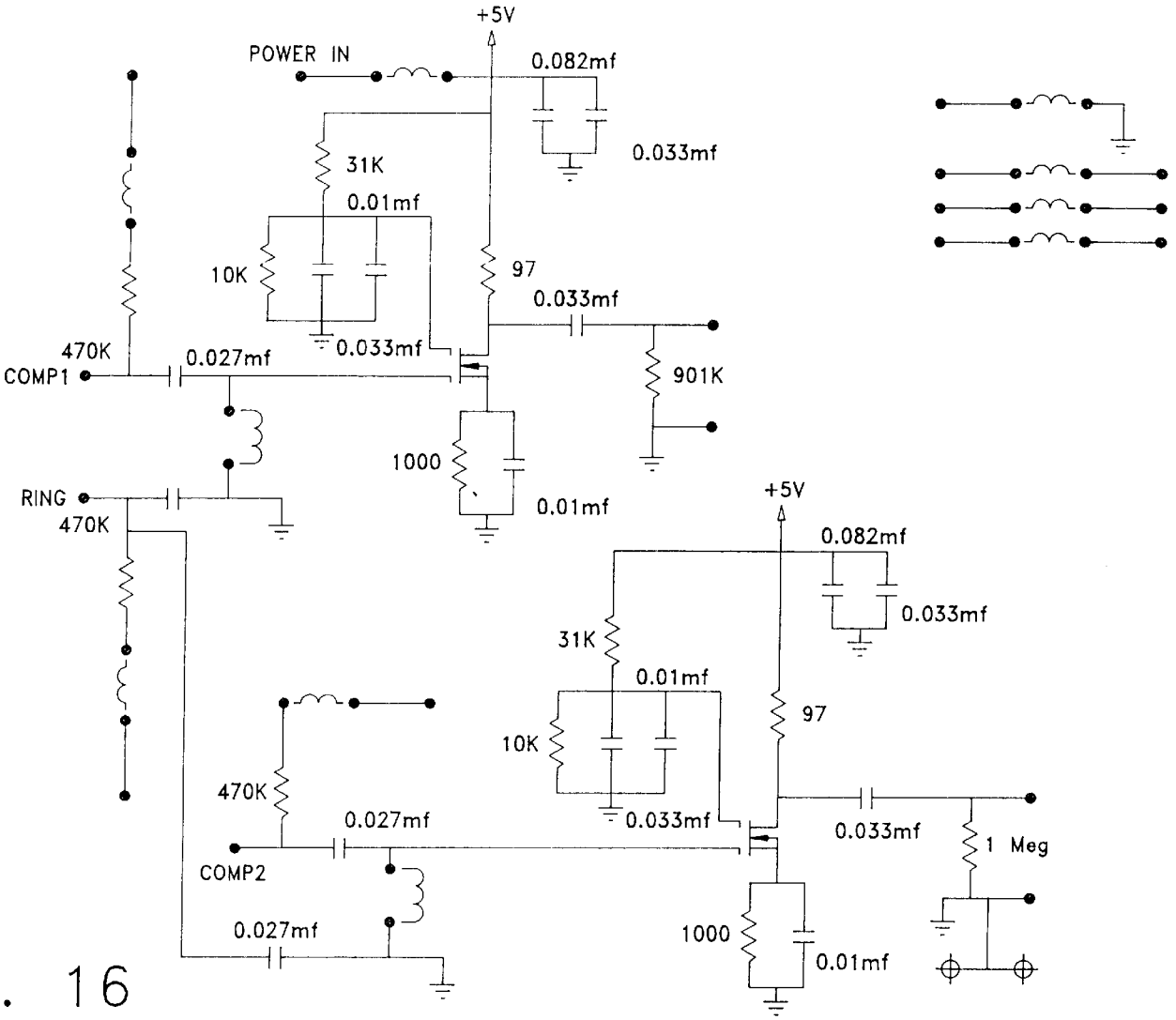
FIG. 16 is a schematic representation of an RLC circuit used in connection with detecting antiprotons trapped in the container of the present invention.

Referring now to FIGS. 14–16, antiprotons may be detected within the antiproton trap formed by magnet assembly 300 and electrode assembly 400 by observation of changes in the noise spectrum emanating from the penning region defined within gap 315. Briefly, without antiprotons present in the penning region of the trap, the noise spectrum will exhibit a Lorentzian shape (see FIG. 14) when the frequency of the noise is plotted as a function of the average of the square of the signal voltage ($u_s^2=4\ kT_0R\Delta v$ where k=Boltzman's constant, $T_0$ is absolute temperature in degrees Kelvin, R is the input resistance and Δv is the spectral width). This effect is well known, and is often referred to as Johnson noise. Antiprotons present within the penning region of the trap cause the noise from the center of the spectrum (FIG. 15) to be shunted by their effective impedance. The emission frequency of the antiprotons, where their effective impedance shunts the spectrum, is approximately 780 kHz. The shunting line width (indicated as reference numeral 500 in FIG. 15) may also be used to determine the number of antiprotons in the penning region of container 5.

This effect and its use as a technique for the measurement of quantities of matter, e.g., electrons, is fully described and understandable to those skilled in the art in an article entitled "Principles of the Stored Ion Calorimeter" by D. J. Wineland and H. G. Dehmelt, Department of Physics, University of Washington, Seattle, Wash., U.S.A.; published in the Journal of Applied Physics, Vol. 46, No. 2, pages 919 to 930, Feb. 1975, which article is hereby incorporated herein by reference.

Referring now to FIGS. 2 and 16, a detector 600 is disposed on the exterior of magnet assembly 300, via mounting supports, that are adapted to secure detector 600 to the antiproton trap. Detector 600 comprise an electric board (schematically illustrated in FIG. 16) that comprises receiver means, such as a tuned resonant RLC circuit, that are tuned for detection of the radio frequency emissions of the antiprotons trapped in the penning region formed within gap 315 (about 780 kHz). In this way, the oscillations of the antiprotons are detected within the antiproton trap after their injection, with their number being determined by the method disclosed hereinabove.

Figure 17:
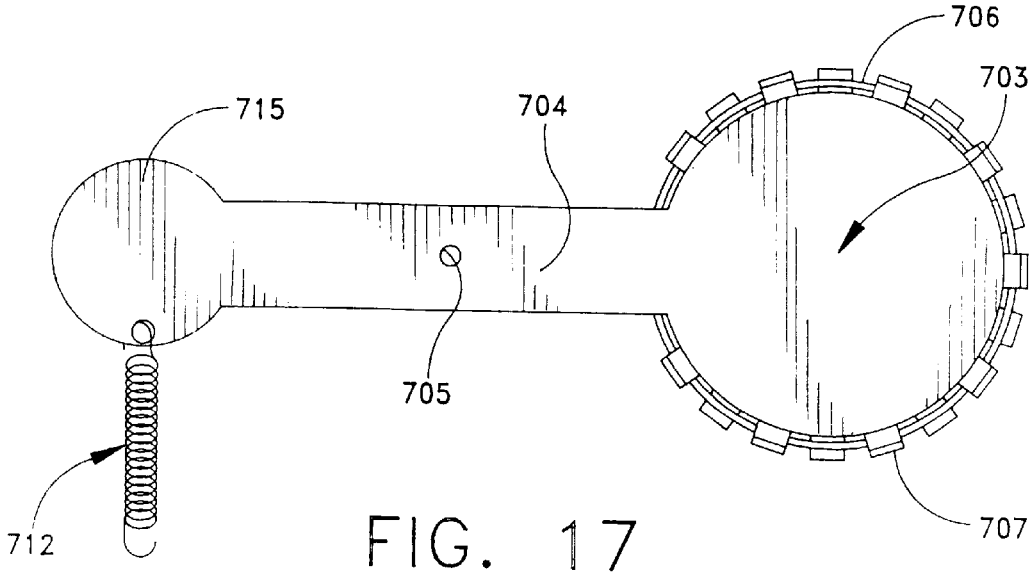
FIG. 17 is a front elevational view of a shutter, including a return spring.
Figure 18:
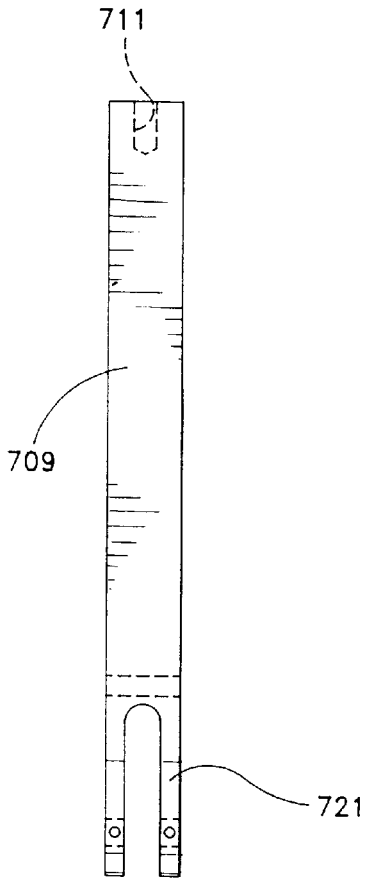
FIG. 18 is a front elevational view of a shutter support.

Referring to FIGS. 1 and 17–18, shutter mechanism 700 is adapted to substantially cover beam port 287 to prevent stray atoms from wandering into the antiproton trap from the evacuated cavities formed by second tail 251, first tail assembly 248 and snout assembly 100. Shutter mechanism 700 is fastened to base plate 240 so that it may be positioned between beam port 287 and the entrance to open ended passageway 320. From this position, it may be pivoted into and out of position in front of beam port 287. Shutter mechanism 700 comprises a shutter 703, a coiled conductor 706, a shutter support 709, and a return spring 712. More particularly, shutter 703 comprises a ring or disk of either a polymer or metal material and a shaft portion 704 having a pivot hole 705 defined midway along its length. Coiled conductor 706 is wound onto the circumference of the disk portion of shutter 703 and is held in place by tabs 707. Coiled conductor 706 is electrically interconnected to a selectively energizable source of electrical potential (shown generally at reference numeral 510 in FIG. 1). A counter weight 715 is disposed at one end of shaft portion 704. Shutter support 709 includes a pivot yoke 721 through which a pivot pin pivotally maintains shutter 703 in position. A blind bore 711 is defined at the end of shutter support 709, and is adapted to receive a fastener, such as bolt 242. Return spring 712 is fastened between a portion of shutter support 709 and counter weight 715. Coiled conductor 706 is adapted to be energized at a predetermined current so as to cause shutter 703 to pivot about pivot hole 705 when in the presence of a magnetic field, such as the fringe field of the trap magnets 302. Return spring 712 helps to bias shutter 703 back to its "at-rest" position (in front of port 287) when coil 706 is not energized. In, this way, shutter 703 acts as a baffle between the cryogenic vacuum, near to magnet assembly 300, and the relatively warm vacuum region of the outer tails and injection/ejection snout assembly 100. Of course other means for separating the evacuated regions of container 5 may be used without departing from the scope of the invention. For example, and not by way of limitation, an iris mechanism, a series of movable slats, or a movable diaphragm, etc., may all be used to selectively obstruct the entrance to the antiproton trap.

Figure 19:
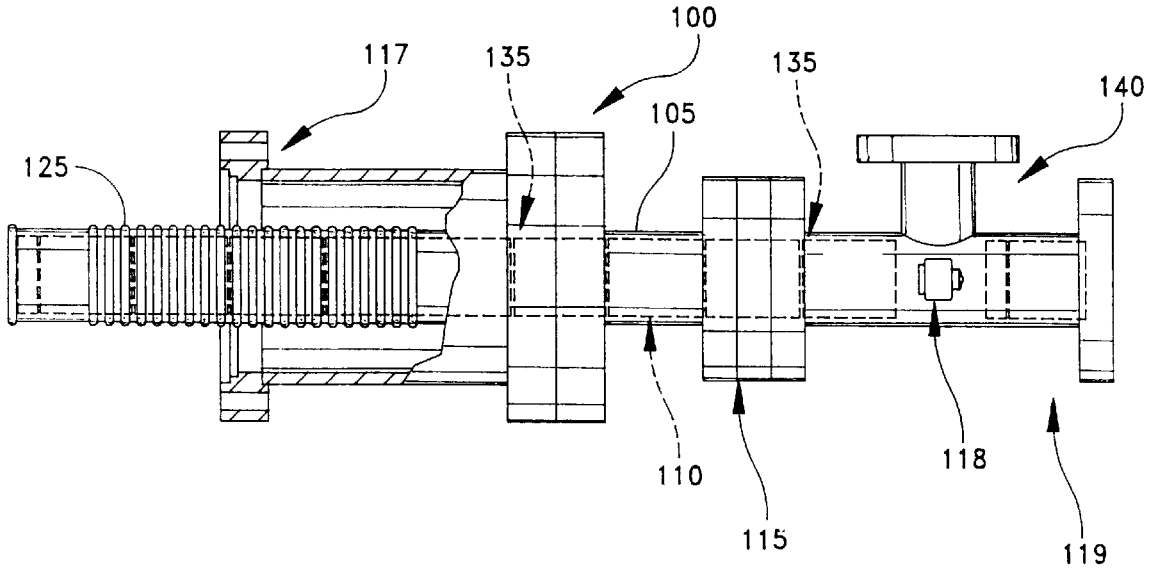
FIG. 19 is a side elevational view, partially in section and partially in phantom, of an antiproton injection/ejection snout assembly.
Figure 20:
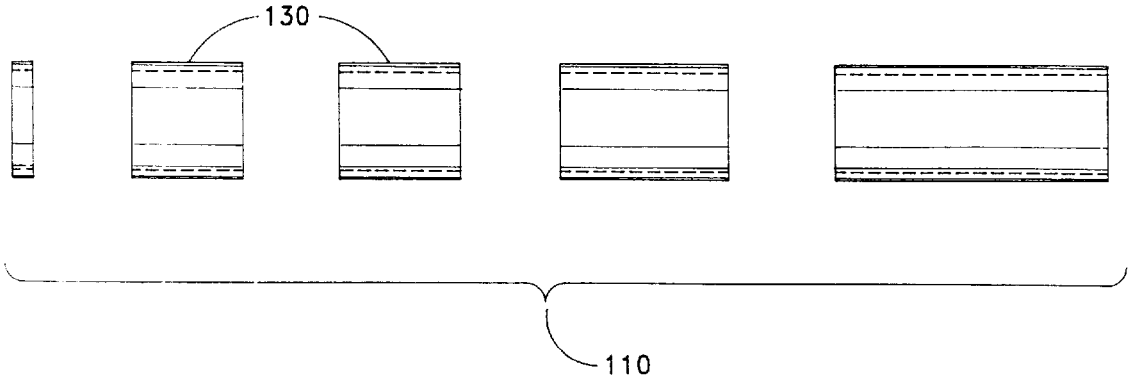
FIG. 20 is a side elevational view of an einsel lens electrode assembly formed in accordance with the present invention.

Referring to FIGS. 19 and 20, antiproton injection/ejection snout assembly 100 comprises a plurality of outer tubes 105, an einsel lens assembly 110, an electron gun 118, and a target container 120. Snout assembly 100 is adapted to be sealingly attached to and detached from, vacuum shell 203. More particularly, outer tubes 105 are formed from a plurality of cylindrical sections that are fastenable, end-to-end, to create an elongate tubular structure 115 (FIGS. 1 and 19). Tubular structure 115 comprises a proximal portion 117 and a distal portion 119. A flexible bellows tube 125 is disposed at the proximal end of tubular structure 115 to help align and sealingly mate with snout interface port 226. Bellows tube 125 allows for compensation of minor tolerance mismatches between snout assembly 100 and snout interface port 226 during assembly of container 5 to snout assembly 100.

Einsel lens assembly 110 comprises a plurality of coaxially aligned, cylindrical tubes 130 that are formed from a highly conductive metal, e.g., copper or its alloys. Tubes 130 are sized so as to fit within bellows tube 125 and tubular structure 115 with gaps 135 defined between predetermined groups of tubes 130 so as to form strong electric field gradients adjacent to the edge portions of the tubes that are positioned on either side of a gap 135. Einsel lenses that are contemplated for use with the present invention are well known in the art. Tubes 130 are individually interconnected to a source of high voltage electrical potential (shown generally at reference numeral 510 in FIG. 1). Amount 140 for a conventional electron gun 118 is located adjacent to distal end 119 of tubular structure 115. Electron gun 118 is installed after the injection of antiprotons into the trap for use in further cooling the antiprotons, as will hereinafter be disclosed in further detail. Distal portion 119 also includes mounting means for receiving target container 120 (FIG. 1) adapted to receive ejected antiprotons, such as a container housing diagnostic materials, e.g., organic and/or inorganic compounds comprising one or more atoms of Oxygen, Nitrogen, Fluorine, Iodine, Sodium, Titanium, Tantalum, Xenon, Chromium, etc., for use in PET imaging, once they have been converted to the appropriate short-lived radioisotopes.

Referring again to FIGS. 1, 2, and 3, container 5 is assembled in the following manner. Each magnet support 304 is assembled to base plate 240 with a magnet 302 assembled to it. More particularly, two inner magnet supports 304, comprising circumferentially arranged projections 336 on their yokes 332 are first fastened to base plate 240. Magnet supports 304 are disposed in confronting-relation to one another so that projections 336 project toward one another. Each magnet support 304 is then oriented so as to be positioned in confronting substantially perpendicular relation to the bottom surface of base plate 240. Inner magnet supports 304 are then moved toward base plate 240 until cold fingers 330 engage the surface of base plate 240. In this position, plurality of blind bores 334 of magnet supports 304 are disposed in coaxially aligned relation with bores 241 of base plate 240 (FIG. 9). Fasteners, e.g., thermally conductive screws or bolts, are then driven through the bores to releasably fasten inner magnet supports 304 to base plate 240. A magnet 302 is then positioned within each yoke 332 so that it is supported by projections 336. The inner most magnets 302 are supported by projections 336, and comprise magnetic polarizations as disclosed hereinabove (one polarized radially-inwardly and one polarized radially-outwardly). Gap 315 is formed between these two inner magnets, and creates about a 4 centimeter space between the inner magnets. It will be understood that this distance may be altered by adjusting the longitudinal position of magnets 302 within yokes 332 or by changing the relative spacing of the inner magnet supports on base plate 240. Two outer magnet supports 304 are then fastened to base plate 240, one each on either side of the two inner magnet supports. A magnet 302 is then positioned within each yoke 332 of the outer magnet supports. The magnets 302 that are disposed in the outer magnets supports 304 are longitudinally polarized so that a net longitudinal field component is directed along the axis of open ended passageway 320.

Next, electrode subassembly 400 is arranged so that electrodes 401*a–d* are disposed within magnet mount 405. More particularly, electrodes 401*b* and 401*c* are first inserted into opposite side openings in magnet mount 405. During the assembly of electrodes 401–*d* within magnet mount 405, gap 406 is formed between electrodes 401*b* and 401*c* by the interaction of edges 402 of electrodes 401*b* and 401*c* with internal shoulders 402A and 402B of magnet mount 405. In this way, gap 406 will substantially correspond to gap 315 when electrode assembly 400 is assembled to magnet assembly 300. Gap 406 is disposed substantially centrally within the magnet mount 405 (FIG. 11). Spacer bars 407 are then assembled to the outer sides of magnet mount, 405 prior to assembly to magnets 302. After being fully assembled, electrode subassembly 400 is positioned within open ended passageway 320 of magnets 302. More particularly, electrode subassembly 400 is oriented so as to be disposed in confronting coaxially aligned relation to longitudinal axis 317 of open ended passageway 320. From this position, electrode subassembly 400 is then moved toward and into open ended passageway 320. Electrode subassembly 400 is slid through open ended passageway 320 until the penning region defined by the gaps between electrodes 401*b* and 401*c* is centrally disposed within gap 315.

Next, shutter mechanism 700 is assembled to base plate 240. More particularly, shutter mechanism 700 is first pivotally assembled to shutter support 709. Blind bore 711 is oriented so as to be disposed in opposing coaxial relation with an outer most bore 241 on base plate 240. Shutter support 709 is then fastened to base plate 240 by means of a bolt 242. In this initial, "at rest position" shutter 703 is biased over open ended passageway 320 and by return spring 727. Coiled conductor 706 may then be electrically interconnected to a selectively energizable source of electrical potential (shown generally at reference numeral 510 in Fig.1).

With magnet assembly 300 and shutter mechanism 700 fastened to base plate 240, base plate 240 is then sealably fastened to the edge of second reservoir 209. Base plate 240 may be sealingly fastened to second reservoir 209 by means of indium seals or the like to form hermetically sealed joints therebetween. Tail assembly 212 is then assembled to first reservoir 206 and second reservoir 209 so as to complete dewar assembly 200. It will be understood that the various electrical and vacuum connections that are necessary for the operation of container 5 must be completed prior to the assembly of tail assembly 212. For example, electrode assembly 400 and detector 600 will be electrically interconnected to selectively energizable sources of electric potential of the type known in the art (shown generally at reference 510 in FIG. 1). For example, a regulated power supply, such as the one manufactured by Bertran, or a battery operated version of the same or similar power supply, has been found to be adequate for use with the present invention.

Referring again to FIGS. 1, 2, and 3, second tail 251 is positioned in confronting coaxial relation with second reservoir 209. From this position second tail 251 is then moved toward base plate 240 of second reservoir 209, and around magnet assembly 300, until annular flange 284 engages bottom 239 of second reservoir 209. Second tail 251 is sealingly fastened to second reservoir 209 by means of indium seals or the like to form a hermetically sealed interface. The interior of second tail 251 forms a cavity that surrounds magnet assembly 300. A similar assembly operation is then completed between first tail 248 and first reservoir 206, i.e., first tail 248 is moved toward first reservoir 206 (and around second tail 251) until annular flange 273 engages the bottom end surface of hollow cylindrical wall 227 where it is hermetically sealed.

It will be understood that the longitudinal axis of snout interface port 226, beam port 276, beam port 287, and longitudinal axis 317 of open ended passageway 320 are all disposed in coaxial alignment with one another. It will also be understood that the various mating and interface surfaces between the various tails and snout assembly are releasably and sealably fastened to one another so as to form a gas tight interconnection. In its fully assembled state, container 5 comprises a substantially closed cylinder having a height of about 1 to 1.5 meters, a diameter of about 0.3 to 0.5 meters, and a fully charged weight of about 23 kilograms. In other words, container 5 is of a size, shape, and weight that is suitable for (i) transportation by conventional terrestrial or air means, and (ii) movement around a hospital, including a patient's room.

After container 5 has been fully assembled, the cavities formed between outer vacuum shell 203, first tail 248 and second tail 251 are evacuated to an ultra-low pressure in the range from approximately $10^{-9}$ to $10^{-13}$ torr. First and second reservoirs 206 and 209 are then filled with liquid nitrogen and liquid helium, respectively, so as to create an ultra-low, cryogenic temperature environment within dewar assembly 200. It will be understood that base plate 240 will be cooled by the liquid helium to about 1–4 degrees Kelvin, and as a consequence, magnet supports 304 and magnets 302 will also be disposed at a substantially cryogenic temperature. The filling of first and second reservoirs 206 and 209 is accomplished via tubular fill lines 221 and 224, respectively.

Injection/ejection snout assembly 100 is assembled separate from container 5 by positioning einsel lens assembly 110 within bellows 125 in tubular structure 115. Snout assembly 100 may be sealingly assembled and disassembled from snout interface port 226 by orienting tubular structure 115 so as to be disposed in coaxially aligned relation to tubular cylinder 266. Tubular structure 115 is then moved toward interface port 226 until annular coupling flange 233 engages a corresponding coupling flange disposed on proximal portion 117. With snout assembly 100 sealingly fastened to snout interface port 226, and the interior of both snout assembly 100 and container 5 evacuated to an ultra-low pressure in the range from approximately $10^{-10}$ to $10^{-13}$ torr, antiprotons may be injected into the antiproton trap from a conventional source of antiprotons, such as a synchrotron or the like.

More particularly, and once again referring to FIGS. 1, 2, and 20, distal portion 119 of snout assembly 100 is sealingly fastened to the source of antiprotons so that antiprotons will enter distal portion 119 of snout assembly 100. It will be understood that antiprotons are produced by, e.g., a synchrotron, at very high energies in a broad band centered about 5–10 GeV, with the actual energy of the antiprotons being dependent upon the production energy. It is also known that beams of antiprotons can be made available at lower beam energies, e.g., in the range of about 50 keV to 5 MeV. For use in connection with container 5, a beam of antiprotons having energies less than 100 keV are preferred.

Next, Einsel lens assembly 110 is selectively energized so as to provide a differential electrical gradient along the length of tubular structure 115 to urge the antiprotons along the longitudinal axis of snout assembly 100 and toward open ended passageway 320 of magnet subassembly 300. As this occurs, electrodes 401*a* and 401*b* are energized so as to provide a differential electric field gradient across the end of open ended passageway 320 that is most distant from snout assembly 100. At the same time, electrodes 401*c* and 401*d* are either not energized, or energized so as to provide a first longitudinally inwardly directed electric field gradient so as to urge the antiprotons entering open ended passageway 320 toward electrodes 401*a* and 401*b*. It will be understood that during the injection of antiprotons into the antiproton trap, shutter mechanism 700 is positioned in its retracted location against the biasing force of return spring 712 so as to clear a path for the antiprotons.

After the a quantity of antiprotons have moved through open ended passageway 320 toward electrodes 401*a* and 401*b*, electrodes 401*c* and/or 401*d* are selectively energized so as to provide a second differential electrical gradient within open ended passageway 320. In this way, the antiprotons are trapped in a potential well formed in the penning region located within gap 315 and between electrodes 401*b* and 401*c* (FIG. 3). Once this has occurred, coiled conductor 706 is deenergized so that return spring 712 biases shutter 703 back to its rest position between open ended passageway 320 and beam port 287. Snout assembly 100 may then be sealingly detached from snout interface port 226. It will be understood that during the unfastening and removal of snout assembly 100 is done by conventional means so as to guard the integrity of the vacuum formed in container 5 from being compromised appreciably.

With the antiprotons disposed within the penning region of the antiproton trap, their presence may be detected by the circuit of detector 600 as disclosed hereinabove. In order to reduce the thermal energy associated with the antiprotons, electron gun 118 is positioned in mount 140 within distal portion 119 of snout assembly 100. Electron gun 118 injects electrons into Einsel lens assembly 110 where they are accelerated along the longitudinal axis of snout assembly 100, through open ended passageway 320 and into the penning region of the antiproton trap. The accelerated electrons collide with the antiprotons and absorb kinetic energy from them. This absorbed kinetic energy is then radiated out of the system by the electrons due to synchrotron radiation caused by the electrons precessing in the magnetic fields of magnets 302. It will be understood that there is no annihilation caused by the interaction between the electrons and antiprotons since they are dissimilar elementary particles.

The application of ultra-low temperatures and ultra-low pressures within container 5, coupled with the injection of cooling electrons, via electron gun 118, combine to maintain the antiprotons at significantly reduced kinetic energies that are suitable for relatively long term storage within the antiproton trap of container 5. As a result of this arrangement, container 5 may be shipped, via conventional commercial air or road transport means, to a location that is within about 90 to about 240 hours from the site of the production of the antiprotons. Container 5 thus provides a structure suitable for transporting antiprotons to a location very distant from their creation.

After container 5 has been delivered to the desired location, e.g., a hospital where PET imaging is to be performed, the previous process is reversed. More particularly, snout assembly 100 is reattached to container 5 and evacuated to a comparable vacuum as that resident within container 5. A target container 120 is then sealingly attached to distal portion 119 of snout assembly 100. Target container 120 may comprise a quantity of diagnostic material, such as oxygen or fluorine, which when bombarded with antiprotons may become populated with short-lived radioisotopes of oxygen or fluorine, through annihilation of one of the protons in the nucleus of an oxygen or fluorine atom by interaction with an antiproton. Radioisotopes of oxygen and fluorine are examples of well known radioisotopes that are adapted for use in PET imaging. Many other elements are also suitable for activation into useful radioisotopes using container 5 of the present invention.

Next, antiprotons are ejected from container 5 by first reenergizing coiled conductor 706 so that shutter 703 is again pivoted out of its rest position between open ended passageway 320 and beam port 287. Next, electrodes 401*c* and 401*d* are deenergized thereby providing a differential electrical field gradient between electrodes 401*a* and 401*b* that urges the antiprotons out of the penning region of the antiproton trap and toward beam port 287. The antiprotons are moved along the longitudinal axis of snout assembly 100 by Einsel lens assembly 110, and into target container 120 where they interact with the diagnostic material to form appropriate radioisotope forms of that material. It will be understood that this procedure is easily accomplished at a patient's bedside.

ADVANTAGES OF THE INVENTION

Numerous advantages are obtained by employing the present invention. For one thing, the present invention provides a container that is adapted for confining, storing, and transporting antiprotons via conventional terrestrial or airborne methods, e.g., commercial airliner, cargo or passenger train, truck, or van, to a location distant from their creation. For another thing, a container formed in accordance with the present invention is capable of maintaining an effective population of antiprotons, at sufficient population levels, to provide adequate quantities for use in medical, industrial, and propulsion applications. Also, the container of the present invention is capable of both being manufactured at a reasonable cost and being reusable.

It is to be understood that the present invention is by no means limited to the precise constructions herein disclosed and shown in the drawings, but also comprises any modifications or equivalents within the scope of the claims.

What is claimed is:

1. A container for transporting antiprotons comprising:

a dewar having an evacuated cavity and a cryogenic cold wall;

a plurality of thermally conductive supports in thermal connection with said cold wall and extending into said cavity;

an antiproton trap mounted on said extending supports within said cavity; and a sealable cavity access port selectively providing access to the cavity for selective introduction into and removal from the cavity of said antiprotons.

2. A container according to claim 1 wherein said dewar comprises at least one reservoir containing a material having a substantially cryogenic temperature wherein said cold wall is positioned in thermally conductive engagement with said at least one reservoir and each of said plurality of thermally conductive supports comprises a planar plate formed from a thermally conductive material, said plates each including an integrally formed antiproton trap mounting yoke disposed at one end wherein said supports are fastened to said cold wall so that said antiproton trap mounting yokes are disposed in coaxially aligned relation to one another.

3. A container according to claim 1 comprising means disposed within said container for selectively separating said antiproton trap from a relatively warmer evacuated portion of said sealable cavity access port.

4. A container according to claim 3 wherein said means for separating comprises a shutter pivotally mounted to said cold wall and comprising means for selectively opening and closing.

5. A container according to claim 1 comprising means for injecting/ejecting antiprotons into/out-of said antiproton trap.

6. A container according to claim 5 wherein said means for injecting/ejecting antiprotons into/out-of said container comprise a snout assembly having a plurality of outer tubes that house an Einsel lens assembly.

7. A container according to claim 6 wherein said snout assembly comprises means for sealingly attaching to and detaching from said sealable cavity access port and further wherein said snout assembly is evacuated to a substantially comparable level as said evacuated cavity.

8. A container according to claim 7 comprising a flexible bellows tube disposed within and at a proximal end of said plurality of outer tubes so as to aid alignment thereof with said sealable cavity access port.

9. A container according to claim 8 wherein said Einsel lens assembly comprises a plurality of coaxially aligned, cylindrical electrically conductive tubes sized so as to fit within said bellows tube wherein gaps are defined between predetermined groups of said Einsel tubes forming electric field gradients adjacent to the edge portions of said tubes that are positioned on either side of a gap when said Einsel tubes are individually interconnected to a source of electrical potential and selectively energized.

10. A container according to claim 7 wherein said snout assembly includes a mount for an electron gun, said mount being located adjacent to a distal end of said snout assembly for injecting electrons into said trap so as to interact with and thereby cool said antiprotons.

11. A container according to claim 10 wherein said distal end of said snout includes mounting means for receiving a target container that is adapted to receive ejected antiprotons.

12. A container according to claim 1 wherein said antiproton trap comprises four magnets each having a longitudinally extending open ended passageway disposed therethrough, with said open ended passageways being coaxially arranged and further wherein the magnetic fields generated by all four of said magnets combine to provide a substantially longitudinally oriented magnetic field at an antiproton confinement region within said open ended passageways.

13. A container according to claim 12 wherein said antiproton confinement region within said open ended passageways is defined by a gap between two of said four magnets.

14. A container according to claim 13 wherein said two magnets are transversely polarized and are spaced apart from one another so as to define said gap.

15. A container according to claim 14 wherein one said two magnets is polarized so as to have a net radial field component directed radially-inwardly and one of said magnets is polarized so as to have a net radial field component directed radially-outwardly.

16. A container according to claim 14 wherein an outer two magnets are longitudinally polarized to both have a net longitudinal field component directed inwardly toward said antiproton confinement region.

17. A container according to claim 16 wherein said antiproton confinement region comprises axial magnetic fields in the range from about 3500 to 4500 Gauss.

18. A container according to claim 12 wherein each of said four magnets comprises a substantially torroidal shape.

19. A container according to claim 12 wherein said antiproton trap comprises a plurality of hollow electrodes that are coaxially positioned within said open ended passageways of said four magnets thereby forming an inner passageway, said plurality of hollow electrodes being electrically insulated from said four magnets and positioned so that one of said hollow electrodes is disposed on a first side of said antiproton confinement region and a second one of said electrodes is disposed on a second side of said antiproton confinement region; and electrical conductors connected to said plurality of hollow electrodes so as to form an electrical circuit wherein said electrical conductors are selectively connectable to a source of electrical potential whereby said plurality of hollow electrodes are selectively energizable so as to selectively provide electric fields within said inner passageway.

20. A container according to claim 19 wherein said one of said hollow electrodes on said first side of said antiproton confinement region is spaced from said second one of said electrodes on said second side of said antiproton confinement region.

21. A container according to claim 19 wherein said plurality of hollow electrodes are supported within said open ended passageways by an electrode cradle.

22. A container according to claim 21 wherein said electrode cradle comprises a tube having a diameter that is (i) large enough to receive at least a portion of each of said plurality of hollow electrodes, and (ii) small enough to allow said tube to be positioned within said open ended passageways.

23. A container according to claim 19 wherein said electrode cradle further comprises at least one dielectric spacer bar fastened to the exterior of said tube by fastening means so as to prevent electrical interaction between said magnets and said hollow electrodes.

24. A container according to claim 23 wherein said at least one spacer bar is fastened to a portion of said dewar.

25. A container according to claim 12 comprising resonant circuit means for monitoring changes in a noise spectrum emanating from said antiproton confinement region when said antiprotons are present therein caused by the effective impedance of said antiprotons in said confinement region.

26. A container according to claim 25 wherein the emission frequency of said antiprotons, where their effective impedance shunts said noise spectrum, is approximately 780 kHz.

27. A container according to claim 1 wherein said dewar comprises at least one reservoir containing a material having a substantially cryogenic temperature wherein said cold wall is positioned in thermally conductive engagement with said at least one reservoir and each of said plurality of thermally conductive supports comprising a planar plate formed from a thermally conductive material, said plates each including an integrally formed antiproton trap mounting yoke disposed at one end wherein said supports are fastened to said cold wall so that said antiproton trap mounting yokes are disposed in coaxially aligned relation to one another; and said antiproton trap comprises four magnets each supported within one of said antiproton trap mounting yokes, each magnet having a longitudinally extending open ended passageway disposed therethrough, with said open ended passageways being coaxially arranged and further wherein the magnetic fields generated by all four of said magnets combine to provide a substantially longitudinally oriented magnetic field at a location within said open ended passageways thereby defining an antiproton confinement region.

28. A container according to claim 1 wherein said dewar comprises at least one reservoir containing a material having a substantially cryogenic temperature wherein said cold wall is positioned in thermally conductive engagement with said at least one reservoir and each of said plurality of thermally conductive supports comprising a planar plate formed from a thermally conductive material, said plates each including an integrally formed antiproton trap mounting yoke disposed at one end wherein said supports are fastened to said cold wall so that said antiproton trap mounting yokes are disposed in coaxially aligned relation to one another; and said antiproton trap comprises four magnets each supported within one of said antiproton trap mounting yokes, each magnet having a longitudinally extending open ended passageway disposed therethrough, with said open ended passageways being coaxially arranged and further wherein the magnetic fields generated by all four of said magnets combine to provide a substantially longitudinally oriented magnetic field at a location within said open ended passageways thereby defining an antiproton confinement region.

29. A container for transporting antiprotons comprising:

a cryogenic dewar having an evacuated cavity and a cold wall;

a plurality of thermally conductive supports in thermal connection with said cold wall and extending into said cavity;

an antiproton trap mounted on said extending supports within said cavity and having a longitudinal axis, said antiproton trap comprising:

at least one magnet having a longitudinally extending open ended passageway providing an antiproton confinement region within said open ended passageway having a substantially longitudinally oriented magnetic field;

at least two hollow electrodes coaxially positioned within said open ended passageway thereby forming an inner passageway, said at least two hollow electrodes being electrically insulated from said at least one magnet and positioned so that one of said at least two electrodes is disposed on a first side of said antiproton confinement region and one of said at least two electrodes is disposed on a second side of said antiproton confinement region;

a sealable access port disposed in aligned relation with said inner passageway and selectively providing access to said cavity and the environment surrounding said dewar; and electrical conductors connected to said at least two hollow electrodes and selectively connectable to a source of electrical potential whereby said at least two hollow electrodes are selectively energizable so as to selectively provide electric fields to control the position of said antiprotons relative to said antiproton confinement region.

30. A container according to claim 29 comprising means disposed within said container for selectively separating said evacuated cavity of said container from a relatively warmer evacuated portion of said sealable cavity access port.

31. A container according to claim 30 wherein said means for separating comprises a shutter pivotally mounted to a peripheral portion of said cold wall and comprising means for selectively opening and closing.

32. A container according to claim 31 wherein said shutter comprises a disk and has a coiled conductor wound onto the circumference of said disk so that when said coiled conductor is selectively energized by a source of electrical potential the fringe fields from said at least one magnet causes said shutter to pivot about a pivot axis and out of position in front of said access port and biased back to an at-rest position by a tension spring disposed between said shutter and said support.

33. A container for transporting antiprotons comprising:

a cryogenic dewar having a substantially evacuated cavity defined by an outer jacket wherein said outer jacket includes a sealable access port that selectively opens into said substantially evacuated cavity for introducing or releasing antiprotons;

an antiproton trap supported by said cryogenic dewar within said evacuated cavity and disposed in thermal communication with said cryogenic dewar;

said antiproton trap including at least one magnet shaped so as to define an open ended passageway having a longitudinal axis, said open ended passageway extending throughout said at least one magnet in coaxially-aligned communicating relation with said access port, said magnet providing an antiproton confinement region within said open ended passageway and having a substantially longitudinally oriented magnetic field;

at least two hollow electrodes coaxially disposed within said open ended passageway of said at least one magnet so as to form an inner passageway, said at least two hollow electrodes being electrically insulated from said at least one magnet and positioned so that one of said at least two electrodes is disposed on a second side of said antiproton confinement region; and a source of electric potential interconnected with said at least two hollow electrodes by means for electively energizing said at least two hollow electrodes so as to control the position of said antiprotons relative to said antiproton confinement region.

34. A method for transporting antiprotons to a point of use comprising the steps of:

(A) providing an antiproton confinement region;

(B) maintaining said antiproton confinement region at an ultra-low pressure and cryogenic temperature;

(C) establishing a controllable magnetic field in said antiproton confinement region;

(D) establishing controllable electric fields in said antiproton confinement region;

(E) controlling said electric fields to urge antiprotons into said antiproton confinement region;

(F) modifying said electric fields to retain antiprotons in said antiproton confinement region;

(G) transporting said antiprotons to a point of use while maintaining said antiproton confinement region at an ultra-low pressure and cryogenic temperature;

(H) modifying at least one of said electric fields to urge said antiprotons from said antiproton confinement region to a point of use.

35. A method for transporting antiprotons to a point of use comprising the steps of:

(A) providing an antiproton confinement region comprising an ultra-low pressure and having a predetermined magnetic field;

(B) providing a first electric field having a portion extending into said antiproton confinement region;

(C) introducing antiprotons into said antiproton confinement region where said antiprotons are influenced by said first electric field;

(D) providing a second electric field having a portion extending into said antiproton confinement region from a different direction than said first electric field and which is equal in strength to said first electric field so that said antiprotons are trapped between said first and second electric fields;

(E) transporting said antiprotons while maintaining said first and second electric fields; and (F) reducing the strength of said second electric field when said antiprotons have arrived at said point of use whereby said first electric field urges said antiprotons to move from said antiproton confinement region.

36. A method for transporting antiprotons to a point of use comprising the steps of:

(A) providing an antiproton confinement region comprising an ultra-low pressure and having a predetermined magnetic field;

(B) providing a first electric field having a portion extending into said antiproton confinement region;

(C) introducing antiprotons into said antiproton confinement region where said antiprotons are influenced by said first electric field;

(D) providing a second electric field having a portion extending into said antiproton confinement region from a different direction than said first electric field and which is equal in strength to said first electric field at a point in said antiproton confinement region so that said antiprotons are trapped between said first and second electric fields;

(E) transporting said antiprotons while maintaining said first and second electric fields; and (F) reducing the strength of said second electric field when said antiprotons have arrived at said point of use whereby said first electric field urges said antiprotons to move from said antiproton confinement region.

37. A system for generating biomedically useful radioisotopes at the bedside of a patient comprising:

a synchrotron for creating antiprotons and positioned at a point that is relatively distant from said bedside;

a first container suitable for transporting antiprotons from said synchrotron to said patients bedside, said container comprising:

a dewar having an evacuated cavity and a cryogenically cold wall;

a plurality of thermally conductive supports in thermal connection with said cold wall and extending into said cavity;

an antiproton trap mounted on said extending supports within said cavity; and a sealable cavity access port selectively providing access to the cavity for selective introduction into and removal from the cavity of said antiprotons;

a second container housing a predetermined quantity of pharmacologically active chemicals, one known property of which is their suitability for transformation into a biomedical radioisotope by bombardment with antiprotons, said second container comprising means for interconnection and release from said first container; and means for injecting/ejecting antiprotons into/out-of said antiproton trap.

* * * * *

UNITED STATES PATENT AND TRADEMARK OFFICE

CERTIFICATE OF CORRECTION

PATENT NO. : 5,977,554
APPLICATION NO. : 09/046064
DATED : November 2, 1999
INVENTOR(S) : Gerald A. Smith et al.

It is certified that error appears in the above-identified patent and that said Letters Patent is hereby corrected as shown below:

Column 1, Line 10, after the title, and before "FIELD OF THE INVENTION" insert the following:

-- GOVERNMENT SPONSORSHIP

This invention was made with government support under Contract No. JPL 958301, awarded by NASA and Contract No. F49620-94-1-0223, awarded by AFOSR. The Government has certain rights in the invention. --

Signed and Sealed this

First Day of July, 2008

JON W. DUDAS
*Director of the United States Patent and Trademark Office*